United States Patent [19]

Kano et al.

[11] Patent Number: 4,801,975

[45] Date of Patent: Jan. 31, 1989

[54] ERASER LAMP AND TRANSPARENT GUIDE PLATE IN ELECTROSTATIC IMAGE TRANSFER

[75] Inventors: Atsushi Kano, Amagasaki; Toshio Watanabe, Takatsuki; Haruo Yamamoto, Osaka; Katsuhide Yamaguchi, Takatsuki; Kenji Oda, Toyonaka; Arihiro Tsunoda, Higashiosaka; Masahiko Fukano, Neyagawa, all of Japan

[73] Assignee: Mita Industrial Co. Ltd., Osaka, Japan

[21] Appl. No.: 39,088

[22] Filed: Apr. 16, 1987

[30] Foreign Application Priority Data

Apr. 18, 1986 [JP] Japan ..... 61-91099
Apr. 26, 1986 [JP] Japan ..... 61-97653
Apr. 26, 1986 [JP] Japan ..... 61-97654

[51] Int. Cl.[4] ..... G03G 15/00

[52] U.S. Cl. ..... 355/14 TR; 355/3 TR; 355/14 E; 355/14 CH

[58] Field of Search ..... 355/3 TR, 14 TR, 14 CH, 355/14 E, 14 SH, 3 CH, 3 SH, 3 R

[56] References Cited

U.S. PATENT DOCUMENTS 3,566,223 2/1971 Salger ..... 355/3 CH X
3,575,502 4/1971 Eppe ..... 355/3 TR
3,689,142 9/1972 Yamanoi et al. ..... 355/3 R
4,260,240 4/1981 Pieper ..... 355/3 TR X
4,525,057 6/1985 Kaufmann et al. ..... 355/3 TR X

FOREIGN PATENT DOCUMENTS 144267 4/1979 Japan ..... 355/14 TR
55-156978 8/1980 Japan .
162577 9/1984 Japan ..... 355/14 E

*Primary Examiner*—A. T. Grimley
*Assistant Examiner*—Ed Pipala
*Attorney, Agent, or Firm*—Bryan, Cave, McPheeters & McRoberts

[57] ABSTRACT

A copying machine, including a photosensitive drum; a corona charger; an exposure device for exposing the photosensitive drum to an optical image of an original; a developing unit for developing a toner image on the photosensitive drum; a transfer corona charger for transferring the developed toner image to copy paper; a device for mechanically separating the imaged copy paper from the photosensitive drum; and a system for cleaning the drum after the image transfer, which includes an eraser lamp disposed adjacent the copy paper delivery side of the transfer corona charger at a position for illuminating copy paper from the rear side thereof upon image transfer thereto, and a control unit for controlling the operation of the transfer corona charger and the eraser lamp, thereby assuring smooth separation of copy paper after image transfer and efficient transport of the paper.

5 Claims, 5 Drawing Sheets

ERASER LAMP AND TRANSPARENT GUIDE PLATE IN ELECTROSTATIC IMAGE TRANSFER

BACKGROUND OF THE INVENTION

Field of the Invention

The present invention relates to image forming apparatus, and more particularly to improvements in devices for erasing charges from the photosensitive member of such apparatus and separating copy paper from the member.

Description of the Prior Art

Image forming apparatus, such as copying machines, have found wide use which comprise a photosensitive drum for forming a toner image on its surface, a transfer corona charger for transferring the toner image to copy paper and a fixing unit for fixing the transferred toner image to the paper. With such apparatus, the copy paper is separated from the photosensitive drum electrostatically by a separating corona charger, or mechanically by a separating belt or pawl.

However, the apparatus incorporating the mechanical separating means has a drawback. For image transfer, the photosensitive drum is charged over the area covered with copy paper and also over areas outside the forward and rear ends of the paper in view of the responsiveness of the transfer corona charger. The charged portion is not discharged immediately after the charging, with the result that toner particles adhering to the cleaning blade or held suspended in the vicinity of the drum are attracted to the charged portion. These toner particles produce an adverse influence on the latent image to be subsequently formed on the photosensitive drum.

To remove the undesirable charges, a charge eraser has been proposed which is positioned free of interference with the copy paper to be transported for removing charges from the photosensitive drum after the separation of copy paper (see, for example, Unexamined Japanese Patent Publication No. 55(1980)-156978).

The eraser becomes soiled with suspended toner particles in the vicinity of the drum and must therefore be cleaned. The eraser which is so disposed as stated above then requires some mechanism for rendering the eraser removable for cleaning. This entails the problem that the power supply connection means for the eraser becomes complex.

When the aforementioned mechanical separating means is used, one side of the copy paper is forcibly removed, and the remaining portion is further removed by a force transmitted through the paper itself from the removed side, against electrostatic attraction between the drum and the paper. Accordingly, the mechanical means has the problem that the copy paper is not separable and transportable smoothly when having low stiffness or a large width.

SUMMARY OF THE INVENTION

The present invention provides an image forming apparatus which comprises , as arranged around electrostatic latent image bearing means, main charging means, means for exposing the image bearing means to an optical image of an original, developing means, transfer means having a transfer corona charger, mechanical separating means and cleaning means. The image forming apparatus is characterized in that it comprises an eraser lamp disposed adjacent to the copy paper delivery side of the transfer corona charger at a position for illuminating copy paper from the rear side thereof upon image transfer thereto, and a control unit for controlling the operation of the transfer corona charger and the eraser lamp.

The image forming apparatus of the present invention assures smooth separation of copy paper after image transfer and efficient transport of the paper.

DESCRIPTION OF THE PREFERRED EMBODIMENTS

Figure 1:
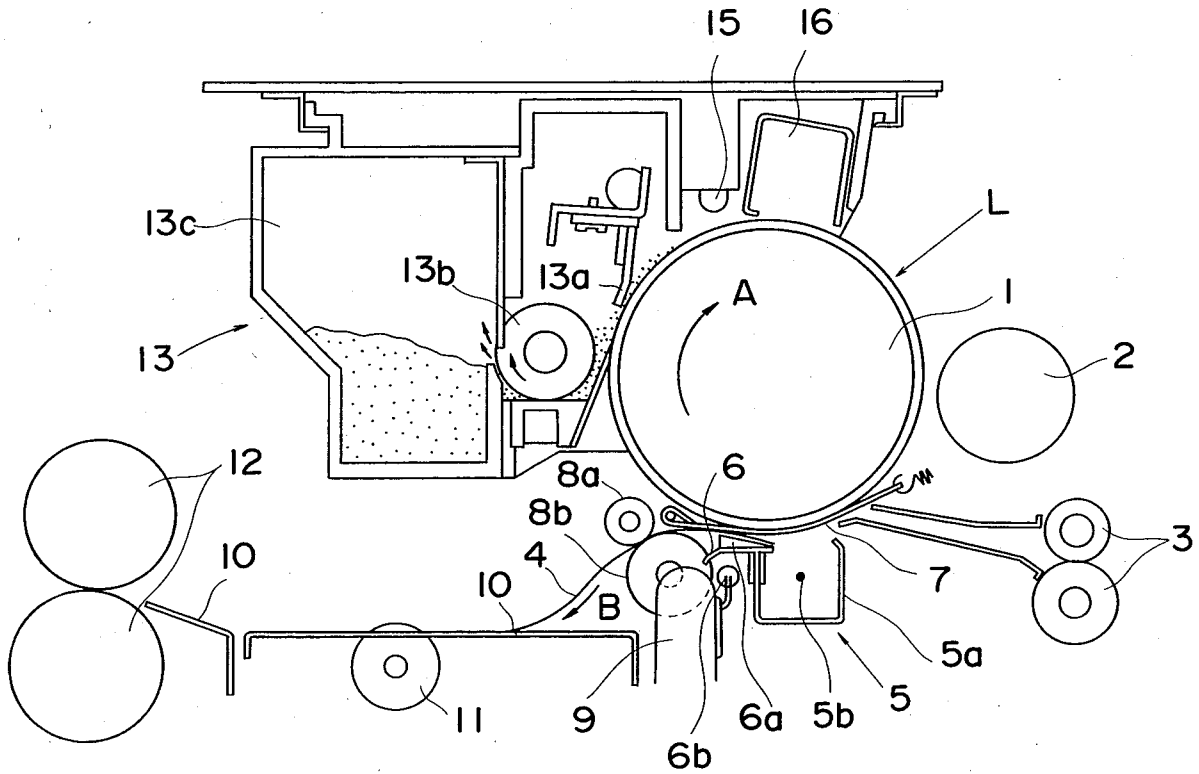
FIG. 1 is a diagram showing the construction of a copying machine having incorporated therein an embodiment of the invention.

The image forming apparatus of the present invention may be composed of the following known means: electrostatic latent image bearing means (such as a photosensitive drum), main charging means (such as a corona charger), means for exposing the image bearing means to an optical image of an original (such as means of the digital type having a laser light source or means of the analog type having a halogen lamp), means for developing the latent image on the image bearing means, a transfer corona charger for transferring the developed image to copy paper, means for mechanically separating from the bearing means the copy paper having the transferred image thereon, and means for cleaning the bearing means after the image transfer.

The image forming apparatus of the present invention is characterized in that the apparatus comprises an eraser lamp disposed adjacent to the copy paper delivery side of the transfer corona charger at a position for illuminating copy paper from the rear side thereof upon image transfer thereto, and a control unit for controlling the operation of the transfer corona charger and the eraser lamp.

Preferably, the control unit is adapted to measure a transfer period including a predetermined period of time before the leading end of the copy paper reaches the transfer corona charger and a predetermined period of time after the rear end of the copy paper has passed the transfer corona charger, to energize the transfer corona charger at least during the transfer period and to turn on the eraser lamp to illuminate at least the rear side of the copy paper and the image bearing means over the area thereof charged by the transfer corona charger.

Preferably, the image forming apparatus further comprises a transparent guide plate which is so disposed as to cover the eraser lamp and to guide the copy paper from the transfer corona charger toward a direction for further transport after the copy paper has been separated from the image bearing means.

Further preferably, the guide plate has a plurality of transparent projections each in the form of a thin plate for guiding the copy paper smoothly. The projections are arranged at a specified angle with respect to the direction of transport of the copy paper, or are arranged at a specified angle as oriented in a direction at the central portion of the plate and at a specified angle as oriented in a direction opposite to the direction at least at one end portion of the guide plate.

The present invention will be described below in greater detail with reference to the embodiments shown in the drawings. However, the invention is in no way limited to these embodiments.

Arrangement of Eraser Lamp and Transparent Guide Plate

FIG. 1 is a diagram showing the construction of a copying machine including an embodiment of the invention. The diagram shows a photosenstive drum 1 rotatable in the direction of arrow A during copying operation, a developing roller 2 included in an unillustrated developing unit, resist rollers 3 rotatable under specified timing for feeding copy paper 4 to the drum 1, a transfer corona charger 5, a case 5*a* therefor, a charge wire electrode 5*b*, a transparent guide plate 6 made of polycarbonate and extending from the case 5*a* of the corona charger 5 for supporting the copy paper 4 from the rear side thereof and guiding the paper in a direction for further transport, ribs 6*a* formed on the guide plate 6, an eraser lamp 6*b* covered with the guide plate 6 from above, a separating belt 7 for mechanically separating one side of the copy paper 4 from the drum 1, a pair of separating rollers 8*a*, 8*b* for nipping the paper side separated by the belt 7 to further separate the paper and transport the paper in the direction of arrow B, a guide 9 for guiding the paper 4, guide plates 10 for guiding the paper, a transport roller 11, fixing rollers 12, a cleaning unit 13, a blade 13*a* for scraping residual toner off the surface of the drum 1 after image transfer, a collecting roller 13*b* for collecting the removed toner into a tank 13*c*, an eraser lamp 15 for uniformly removing charges from the surface of the drum 1, a corona charger 16 for uniformly charging the drum surface, and image light L obtained by illuminating an original with unillustrated exposure means.

Figure 2:
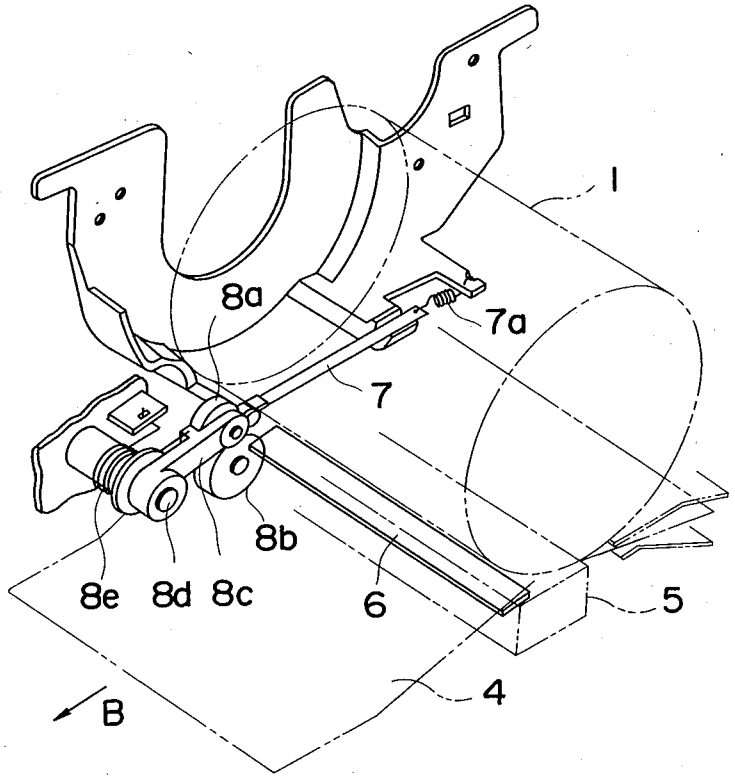
FIG. 2 is a fragmentary perspective view of FIG. 1.

FIG. 2 is a fragmentary perspective view showing the copying machine of FIG. 1. Indicated at 7*a* is a spring for tensioning the separating belt 7 to hold the belt in intimate contact with the drum 1, and at 8*c* is a lever movable about a pivot 8*d* and biased by a spring 8*e* to press the roller 8*a* against the roller 8*b*.

Construction and Operation of Transparent Guide Plate

Figure 3:
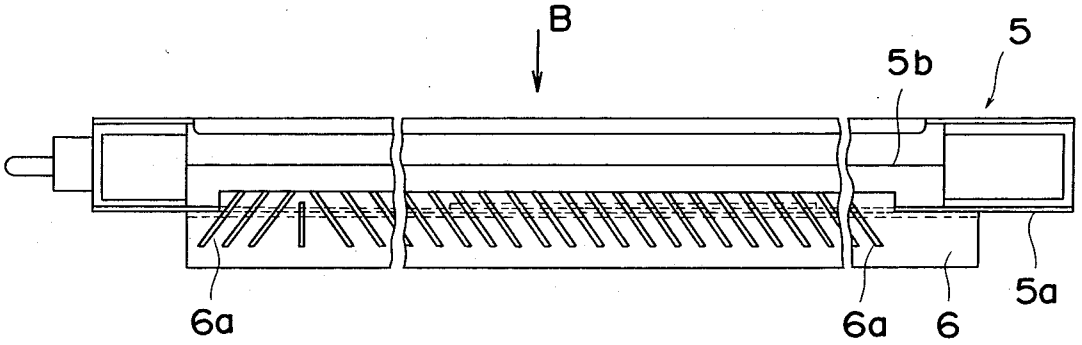
FIG. 3 is a fragmentary plan view of FIG. 1.

FIG. 3 is a plan view showing the transfer corona charger 5 and the guide plate 6 which extends from the side plate of the case 5*a* at the copy paper delivery side of the charger 5. The guide plate 6 has 40 ribs 6*a* arranged at a spacing of 5 mm and measuring 13 mm in maximum length, 2.5 mm in maximum height and 1 mm in thickness. Of these ribs 6*a*, three ribs close to the separating belt (i.e. those at the left side of FIG. 3) are arranged in parallel at an angle of −35 degrees with respect to the direction of transport of the copy paper (the direction of arrow B), another rib is in parallel with this direction, and the remaining 36 ribs are arranged in parallel at an angle of +35 degrees with respect to the direction of transport.

If the guide plate 6 is a flat plate like the conventional one, the frictional resistance between the paper 4 and the plate 6 is great and is liable to undulate the paper 4 above the corona charger 5, thereby locally separating the paper from the drum 1 to result in improper image transfer although this phenomenon is dependent on the stiffness of the paper.

According to the present embodiment, the guide plate 6 has the ribs 6*a* shown in FIG. 3, so that the copy paper 4 is brought into point-to-point contact with the ribs 6*a* with reduced frictional resistance. Further as the paper is transported on the guide plate, the points of contact between the paper and the ribs 6*a* shift outward in width wise directions of the paper, forcing the paper to stretch width wise at all times regardless of the paper size. Consequently, even if the copy paper 4 has relatively low stiffness or contains a large amount of moisture, the paper can be forwarded smoothly without undulation or creasing for satisfactory image transfer.

Control Circuit

Figure 4:
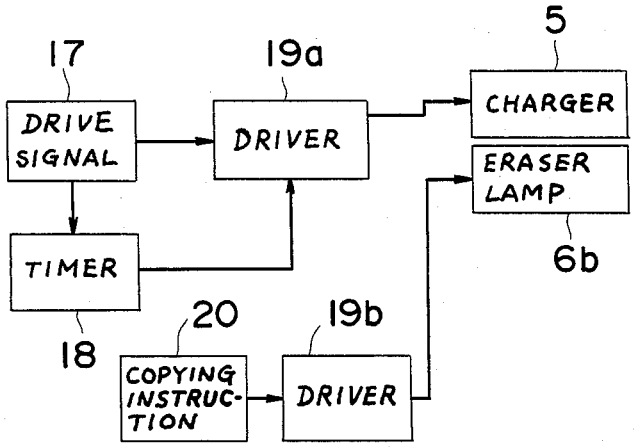
FIG. 4 is a fragmentary block diagram showing a control circuit for the machine of FIG. 1.

FIG. 4 is a fragmentary block diagram showing the control circuit of the copying machine of FIG. 1. During copying operation, the machine produces a drive signal 17 for the resist rollers 3. A timer 18 is set by the resist roller drive signal 17 to start measuring time. The timer measures the period of time taken for the rear end of the copy paper to completely pass over the guide plate 6 and delivers an output, whereupon the timer 18 is reset. A driver 19*a* for the corona charger 5 operates in response to the resist roller drive signal 17 and is brought out of operation by the output from the timer 18. A driver 19*b* for the eraser lamp 6*b* is brought into operation by a copying instruction 20 and held in operation during the copying cycle.

Operation of Eraser Lamp 6*b*

The copying machine of the foregoing construction is initiated into operation by the copying instruction 20 which drives the photosensitive drum 1, developing roller 2, separating rollers 8*a*, 8*b*, transport roller 11, fixing rollers 12 and collecting roller 13*b*, turns on the eraser lamps 6*b*, 15 and energizes the corona charger 16. The image light L from an original forms on the surface of the drum 1 an electrostatic latent image, which is then developed by the developing roller 2. The resist rollers 3 are driven under such timing that the copy paper 4 thereby fed to the drum 1 will be in register with the developed image on the drum 1. The resist roller drive signal 17 drives the driver 19*a*, energizing the corona charger 5, which in turn applies a transfer high voltage to the surface of the drum 1. At the same time, the charges thereby imparted to the drum surface are continuously erased with the light projected from the eraser lamp 6*b* onto the drum 1 through the guide plate 6. In this state, the copy paper 4 reaches a position above the corona charger 5. The paper is further transported while one side thereof is being separated from the drum 1 by the separating belt 7, with the other portion of the paper held in contact with the drum 1, whereby the developed image is transferred from the drum 1 to the paper 4, first at its leading end. The paper 4 having the image transferred thereto is guided by the guide plate 6 while being irradiated with the light of the eraser lamp 6*b* from its rear side, is held between the separating rollers 8*a*, 8*b* and is further transported on the guide plates 10 after separation from the drum 1. The transport roller 11 feeds the paper 4 to the fixing rollers 12, by which the image is fixed to the paper, whereupon the paper is discharged from the machine. When the rear end of the paper 4 has completely passed over the guide plate 6 during travel, the timer 18 produces an output, stopping the driver 19b to deenergize the corona charger 5.

While the image transfer operation is completed at the rearmost end of the copy paper 4, the excessive charges given to the drum surface by the corona charge are erased with the light of the eraser lamp 6b irradiating the drum surface through the transparent guide plate 6.

Thus, the eraser lamp 6b illuminates the copy paper immediately after the image transfer to erase some of the residual charges, thereby diminishing the electrostatic attraction between the paper and the drum 1 and rendering the paper separable from the drum 1 easily. The operation of the eraser lamp is combined with the action of the guide 6 to make the paper transportable with improved efficiency.

Furthermore, the copying machine can be made compact since the guide plate 6 of transparent material is provided adjacent to the transfer corona charger 5 with the eraser lamp 6b disposed under the guide plate 6.

Figure 5:
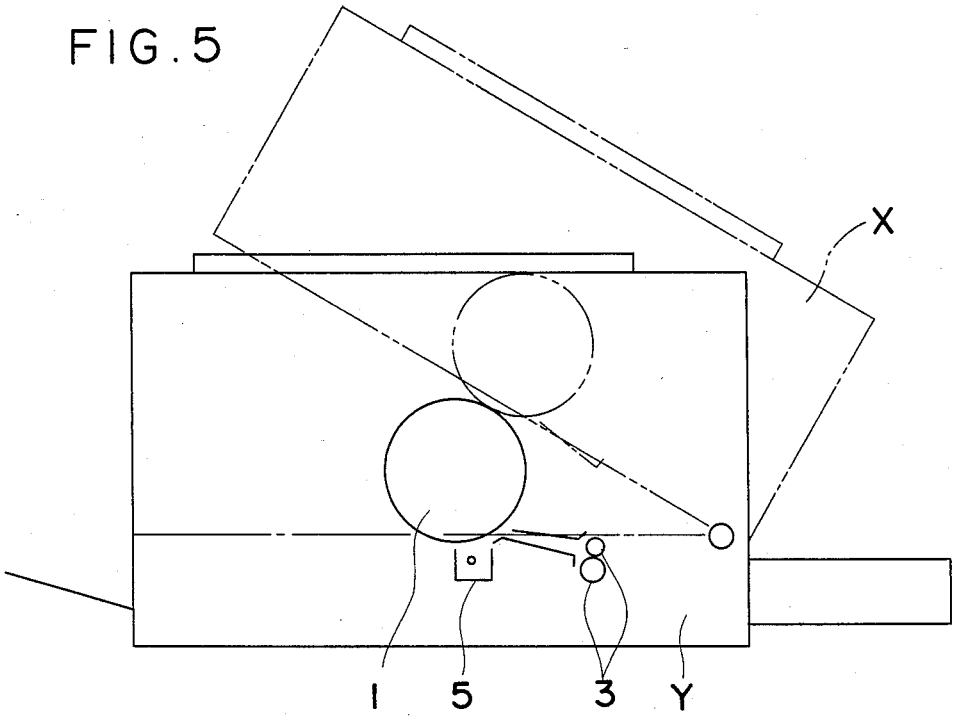
FIG. 5 is a side elevation schematically showing the copying machine of FIG. 1.

With reference to FIG. 5 which is a side elevation schematically showing the copying machine of FIG. 1 in its entirety, the machine main body is divided into an upper portion X and a lower portion Y generally along the path of transport of the copy paper, and the upper portion X is openable for remedying paper jams, cleaning the interior and other maintenance work. Accordingly, when toner adheres to the guide plate 6 6, which is exposed along the path of transport of the copy paper, can be easily cleaned without the necessity of removing the plate.

Other Embodiment of Transparent Guide Plate

Figure 6:
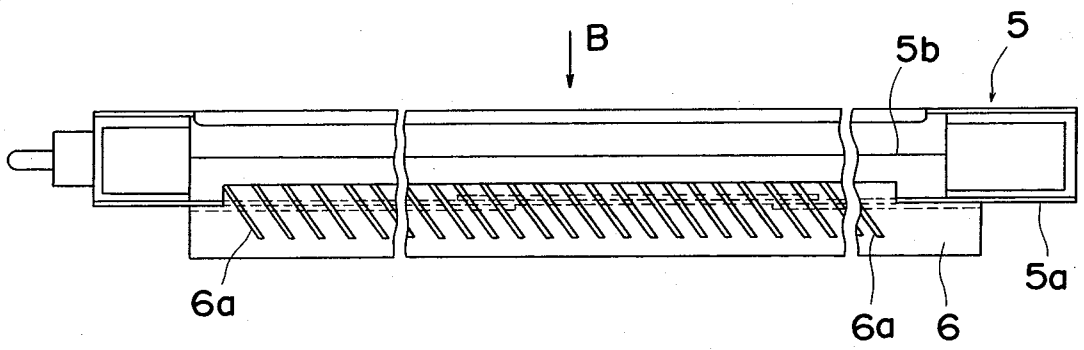
FIG. 6 is a view corresponding to FIG. 3 and showing another embodiment of the invention.

FIG. 6 is a view corresponding to FIG. 3 and showing another embodiment of the invention. The guide plate shown in FIG. 6 has the same construction as the one shown in FIG. 3 except that ribs 6a are all oriented at an angle of +30 degrees with respect to the direction of transport of copy paper. The guide plate 6 of FIG. 6 is used when copy paper 4 tends to deviate from the transport direction toward the separating rolls 8a, 8b. The deviating force acting width wise of the copy paper is equilibrated with an opposite force by the guide plate 6 to assure smooth transport of the paper.

Toner particles are liable to be suspended in the vicinity of the corona charger 5 and tend to adhere to the guide plate 6. According to the invention, however, the copy paper 4 comes into contact with the forward ends of the ribs 6a to which the toner will not adhere readily. This obviates the likelihood that suspended toner particles will smudge the copy paper 4.

What is claimed is:

1. In an image forming apparatus comprising, as arranged around electrostatic latent image bearing means, main charging means, means for exposing the image bearing means to an optical image of an original, developing means,transfer means having a transfer corona charger, mechanical separating means and cleaning means, the improvement comprising:

(a) an eraser lamp disposed adjacent to the copy paper delivery side of the transfer corona charger at a position for illuminating copy paper from the rear side thereof upon image transfer thereto; and (b) a control unit for controlling the operation of the transfer corona charger and the eraser lamp, the control unit comprising:

(i) means for measuring a transfer period including a predetermined period of time before the leading end of the copy paper reaches the transfer corona charger and a predetermined period of time after the rear end of the copy paper has passed the transfer corona charger, and (ii) means for energizing the transfer corona charger at least during the transfer period and for turning on the eraser lamp to illuminate at least the rear side of the copy paper and the image bearing means over the area thereof charged by the corona charger.

2. An apparatus as defined in claim 1, which further comprises a transparent guide plate so disposed as to guide the copy paper from the corona charger toward a direction for further transport after the copy paper has been separated from the image bearing means and to cover the eraser lamp.

3. In an image forming apparatus comprising, as arranged around electrostatic latent image bearing means, main charging means, means for exposing the image bearing means to an optical image of an original, developing means, transfer means having a transfer corona charger, mechanical separating means and cleaning means, the improvement comprising:

(a) an eraser lamp disposed adjacent to the copy paper delivery side of the transfer corona charger at a position for illuminating copy paper from the rear side thereof upon image transfer thereto;

(b) a control unit for controlling the operation of the transfer corona charger and the eraser lamp, the control unit comprising:

(i) means for measuring a transfer period including a predetermined period of time before the leading end of the copy paper reaches the transfer corona charger and a predetermined period of time after the rear end of the copy paper has passed the transfer corona charger, and (ii) means from energizing the transfer corona charger at least during the transfer period and for turning on the eraser lamp to illuminate at least the rear side of the copy paper and the image bearing means over the area thereof charged by the corona charger; and (c) a transparent guide plate so disposed as to guide the copy paper from the corona charger toward a direction for further transport after the copy paper has been separated from the image bearing means and to cover the eraser lamp, said guide plate having a plurality of transparent projections each in the form of a thin plate for guiding the copy paper smoothly.

4. An apparatus as defined in claim 3 wherein the projections on the guide plate are arranged at a specified angle with respect to the direction of transport of the copy paper.

5. An apparatus as defined in claim 3 wherein the projections on the guide plate are arranged at a specified angle as oriented in a direction at the central portion of the plate and at a specified angle as oriented in a direction opposite to the oriented direction at least at one end portion of the guide plate so as to stretch the copy paper width wise thereof while guiding the paper.

* * * * *

UNITED STATES PATENT AND TRADEMARK OFFICE

CERTIFICATE OF CORRECTION

PATENT NO. : 4,801,975

DATED : January 31, 1989

INVENTOR(S) : Atsushi Kano et al

It is certified that error appears in the above-identified patent and that said Letters Patent is hereby corrected as shown below:

Col. 6, line 42: change "means from" to --means for--;

Col. 6, line 66: change "width wise" to --widthwise--.

Signed and Sealed this

Twenty-fifth Day of July, 1989

*Attest:*

*Attesting Officer*

DONALD J. QUIGG

*Commissioner of Patents and Trademarks*